US009932780B2

(12) United States Patent
Spencer et al.

(10) Patent No.: US 9,932,780 B2
(45) Date of Patent: Apr. 3, 2018

(54) DRILL BIT WITH EXTENDABLE GAUGE PADS

(71) Applicants: Reed W. Spencer, Spring, TX (US); Chaitanya K. Vempati, Conroe, TX (US)

(72) Inventors: Reed W. Spencer, Spring, TX (US); Chaitanya K. Vempati, Conroe, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 257 days.

(21) Appl. No.: 14/506,730

(22) Filed: Oct. 6, 2014

(65) Prior Publication Data

US 2016/0097237 A1 Apr. 7, 2016

(51) Int. Cl.

| | |
|---|---|
| ***E21B 10/00*** | (2006.01) |
| ***E21B 17/10*** | (2006.01) |
| ***E21B 10/633*** | (2006.01) |

(52) U.S. Cl.

CPC ..... *E21B 17/1092* (2013.01); *E21B 10/633* (2013.01)

(58) Field of Classification Search

CPC ..... E21B 17/1092; E21B 10/633

USPC ..... 175/61, 57

See application file for complete search history.

(56) References Cited

U.S. PATENT DOCUMENTS

| | | | | |
|---|---|---|---|---|
| 4,842,083 | A * | 6/1989 | Raney | E21B 10/43 175/325.4 |
| 5,361,859 | A * | 11/1994 | Tibbitts | E21B 10/20 175/286 |
| 5,560,440 | A * | 10/1996 | Tibbitts | E21B 10/20 175/286 |
| 6,971,459 | B2 * | 12/2005 | Raney | E21B 10/43 175/406 |
| 8,746,368 | B2 * | 6/2014 | Johnson | E21B 17/1092 175/384 |
| 2004/0226751 | A1 * | 11/2004 | McKay | E21B 7/20 175/57 |
| 2006/0196697 | A1 * | 9/2006 | Raney | E21B 10/43 175/325.5 |
| 2009/0044979 | A1 * | 2/2009 | Johnson | E21B 7/06 175/24 |
| 2011/0147089 | A1 * | 6/2011 | Kulkarni | E21B 7/064 175/73 |
| 2012/0255788 | A1 * | 10/2012 | Schwefe | E21B 10/62 175/61 |

* cited by examiner

*Primary Examiner* — Taras P Bemko

(74) *Attorney, Agent, or Firm* — Cantor Colburn LLP

(57) ABSTRACT

A drill bit for use in a wellbore is disclosed, including a bit body having a longitudinal axis; and at least one moveable member associated with a lateral extent of the bit body, wherein the at least one moveable member is configured to translate in a member axis that is substantially longitudinal. Further, a method of drilling a wellbore is disclosed, including providing a drill bit including a bit body having a longitudinal axis and at least one movable member associated with a lateral extent of the bit body; conveying a drill string into a formation, the drill string having the drill bit at the end thereof; drilling the wellbore using the drill string; and selectively translating at least one movable member in a member axis that is substantially longitudinal.

20 Claims, 5 Drawing Sheets

DRILL BIT WITH EXTENDABLE GAUGE PADS

BACKGROUND INFORMATION

1. Field of the Disclosure

This disclosure relates generally to drill bits and systems that utilize same for drilling wellbores.

2. Background of the Art

Oil wells (also referred to as "wellbores" or "boreholes") are drilled with a drill string that includes a tubular member having a drilling assembly (also referred to as the "bottom-hole assembly" or "BHA") at the bottom end of the tubular. The BHA typically includes devices and sensors that provide information relating to a variety of parameters relating to the drilling operations ("drilling parameters"), behavior of the BHA ("BHA parameters") and parameters relating to the formation surrounding the wellbore ("formation parameters"). A drill bit attached to the bottom end of the BHA is rotated by rotating the drill string and/or by a drilling motor (also referred to as a "mud motor") in the BHA to disintegrate the rock formation to drill the wellbore. A large number of wellbores are drilled along contoured trajectories. For example, a single wellbore may include one or more vertical sections, deviated sections, curved sections and horizontal sections through differing types of rock formations. Drilling conditions differ based on the wellbore contour, rock formation and wellbore depth. It is often desirable to have a drill bit with a longer vertical or longitudinal sections around the drill bit, also referred to as gauge pads, during drilling of a vertical well section to increase drill bit stability and wellbore quality and relatively short gauge pads for drilling deviated well sections, curved well sections, and horizontal well sections to allow greater deflection and bit control.

The disclosure herein provides a drill bit and drilling systems using the same that includes adjustable longitudinal sections or gauge pads.

SUMMARY

In one aspect, a drill bit for use in a wellbore is disclosed, including a bit body having a longitudinal axis; and at least one moveable member associated with a lateral extent of the bit body, wherein the at least one moveable member is configured to translate in a member axis that is substantially longitudinal.

In another aspect, a method of drilling a wellbore is disclosed, including providing a drill bit including a bit body having a longitudinal axis and at least one movable member associated with a lateral extent of the bit body; conveying a drill string into a formation, the drill string having the drill bit at the end thereof; drilling the wellbore using the drill string; and selectively translating at least one movable member in a member axis that is substantially longitudinal.

In another aspect, a system for drilling a wellbore is disclosed, including a drilling assembly having a drill bit configured to drill a wellbore, the drill bit including: a bit body having a longitudinal axis; and at least one moveable member associated with a lateral extent of the bit body, wherein the at least one moveable member is configured to translate in a member axis that is substantially longitudinal.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DESCRIPTION OF THE EMBODIMENTS

Figure 1:
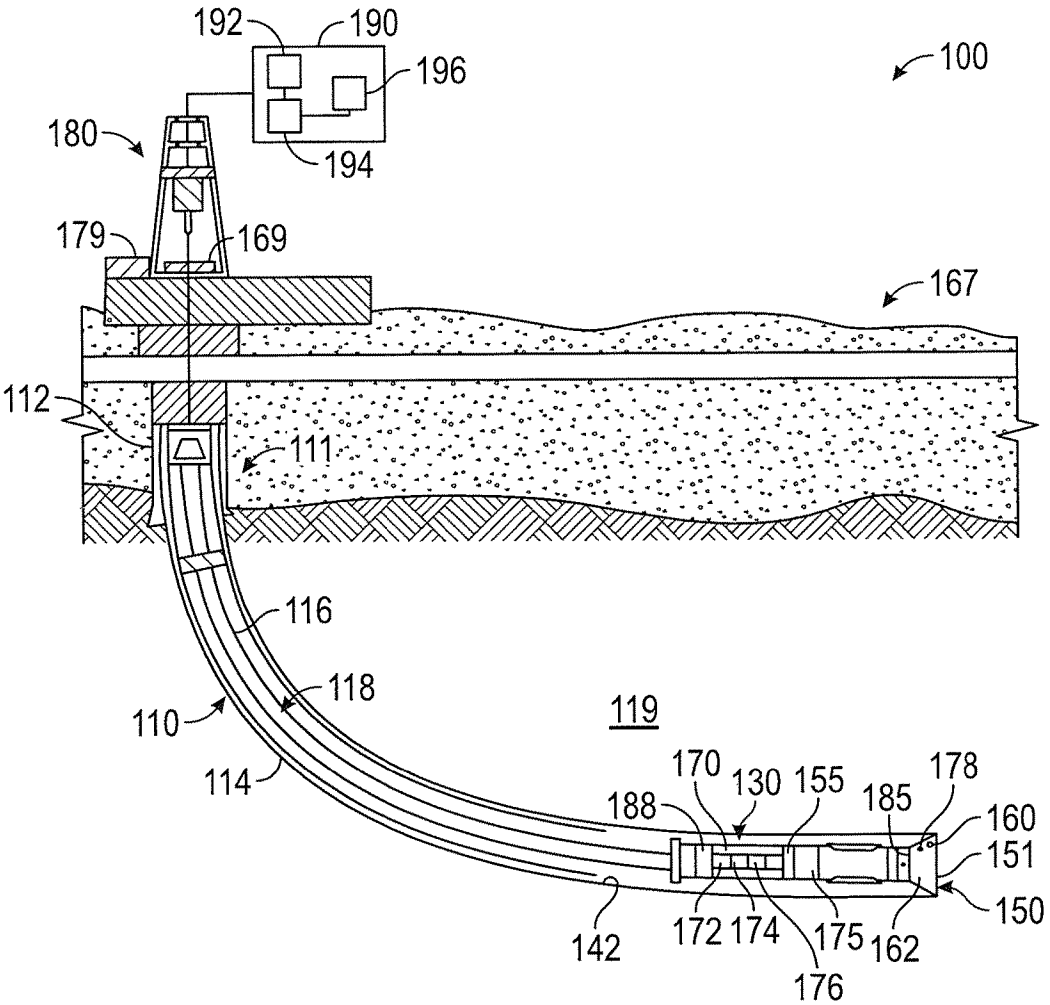
FIG. 1 is a schematic diagram of an exemplary drilling system that includes a drill string that has a drill bit made according to one embodiment of the disclosure.

FIG. 1 is a schematic diagram of an exemplary drilling system 100 that may utilize drill bits made according to the disclosure herein. FIG. 1 shows a wellbore 110 having an upper section 111 with a casing 112 installed therein and a lower section 114 being drilled with a drill string 118. The drill string 118 is shown to include a tubular member 116 with a BHA 130 attached at its bottom end. The tubular member 116 may be made up by joining drill pipe sections or it may be a coiled-tubing. A drill bit 150 is shown attached to the bottom end of the BHA 130 for disintegrating the rock formation 119 to drill the wellbore 110 of a selected diameter.

Drill string 118 is shown conveyed into the wellbore 110 from a rig 180 at the surface 167. The exemplary rig 180 shown is a land rig for ease of explanation. The apparatus and methods disclosed herein may also be utilized with an offshore rig used for drilling wellbores under water. A rotary table 169 or a top drive (not shown) coupled to the drill string 118 may be utilized to rotate the drill string 118 to rotate the BHA 130 and thus the drill bit 150 to drill the wellbore 110. A drilling motor 155 (also referred to as the "mud motor") may be provided in the BHA 130 to rotate the drill bit 150. The drilling motor 155 may be used alone to rotate the drill bit 150 or to superimpose the rotation of the drill bit 150 by the drill string 118. A control unit (or controller) 190, which may be a computer-based unit, may be placed at the surface 167 to receive and process data transmitted by the sensors in the drill bit 150 and the sensors in the BHA 130, and to control selected operations of the various devices and sensors in the BHA 130. The surface controller 190, in one embodiment, may include a processor 192, a data storage device (or a computer-readable medium) 194 for storing data, algorithms and computer programs 196. The data storage device 194 may be any suitable device, including, but not limited to, a read-only memory (ROM), a random-access memory (RAM), a flash memory, a magnetic tape, a hard disk and an optical disk. During drilling, a drilling fluid 179 from a source thereof is pumped under pressure into the tubular member 116. The drilling fluid discharges at the bottom of the drill bit 150 and returns to the surface via the annular space (also referred as the "annulus") between the drill string 118 and the inside wall 142 of the wellbore 110.

Still referring to FIG. 1, the drill bit 150 includes a face section (or bottom section) 151. The face section 151 or a portion thereof faces the formation in front of the drill bit or the wellbore bottom during drilling. The drill bit 150, in one aspect, includes one or more adjustable longitudinal members or pads 160 along the longitudinal side 162 of the drill bit 150. The members 160 are "extensible members" or "adjustable members". A suitable actuation device (or actuation unit) 155 in the BHA 130 or a device 185 in the drill bit 150 or a combination thereof may be utilized to activate the members 160 during drilling of the wellbore 110. Signals corresponding to the extension of the members 160 may be provided by one or more suitable sensors 178 associated with the members 160 or associated with the actuation units 155 or 185.

The BHA 130 may further include one or more downhole sensors (collectively designated by numeral 175). The sensors 175 may include any number and type of sensors, including, but not limited to, sensors generally known as the measurement-while-drilling (MWD) sensors or the logging-while-drilling (LWD) sensors, and sensors that provide information relating to the behavior of the BHA 130, such as drill bit rotation (revolutions per minute or "RPM"), tool face, pressure, vibration, whirl, bending, and stick-slip. The BHA 130 may further include a control unit (or controller) 170 configured to control the operation of the members 160 and for at least partially processing data received from the sensors 175 and 178. The controller 170 may include, among other things, circuits to process the sensor 175 and 178 signals (e.g., amplify and digitize the signals), a processor 172 (such as a microprocessor) to process the digitized signals, a data storage device 174 (such as a solid-state-memory), and a computer program 176. The processor 172 may process the digitized signals, control the operation of the pads 160, process data from other sensors downhole, control other downhole devices and sensors, and communicate data information with the controller 190 via a two-way telemetry unit 188. In one aspect, the controller 170 in the BHA or a controller 185 in the drill bit 150 or the controller 190 at the surface or any combination thereof may adjust the extension of the pads members 160 to control the drill bit fluctuations and/or drilling parameters to increase the drilling effectiveness and to extend the life of the drill bit 150 and the BHA. Increasing the longitudinal gauge pad extension provides a longer vertical section or gauge pad section along the drill bit and acts as a stabilizer, which can effectively reduce vibration, whirl, stick-slip, etc. Reduction in these attributes can increase borehole quality. Similarly, retracting the pads to provide for a shorter vertical section can increase deflection, maneuverability and borehole quality while deviated, including curved and horizontal, portions of a borehole are created. Advantageously, being able to adjust the extension of the adjustable gauge pads 160 allows for enhanced performance and borehole quality in a greater variety of situations.

Figure 2A:
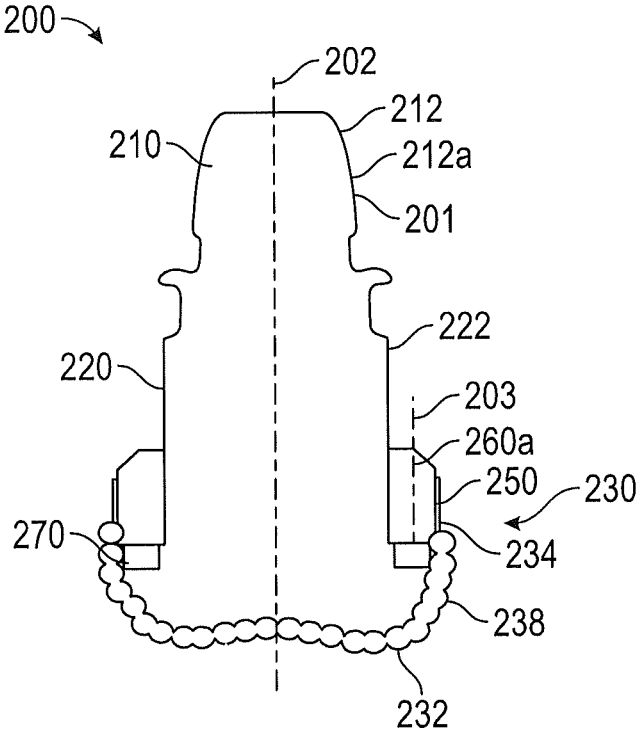
FIG. 2A shows a cross sectional view of an exemplary drill bit with an adjustable member on a bit body, in a retracted position, according to one embodiment of the disclosure.

FIG. 2A shows an exemplary drill bit 200 made according to one embodiment of the disclosure. The drill bit 200 is a bit having a bit body 201 that includes a pin or pin section 210, a shank 220, a crown or crown section 230, and moveable members 260*a*. In an exemplary embodiment, the drill bit 200 is any suitable bit, including, but not limited to roller cone, hybrid, and polycrystalline diamond compact (PDC).

In an exemplary embodiment, the pin 210 has a tapered threaded upper end 212 having threads 212*a* thereon for connecting the drill bit 200 to a box end of the drilling assembly 130 (FIG. 1). The shank 220 has a lower vertical or straight section 222. The crown 230 includes a face or face section 232 that faces the formation during drilling.

In an exemplary embodiment, crown 230 includes cutters 238 on face section 232 as well as lateral extents of crown 230. Such cutters 238 allow for removal of material in the formation.

In an exemplary embodiment, the lateral extents of bit body 201 include static gauge pads 234. Static gauge pads 234 may be provided to combat stick slip, vibration, and whirl, and increase borehole quality. As previously contemplated, the optimal length of gauge pad depends on operating conditions and if vertical, horizontal deviated or curved wellbore path is desired. In certain conditions, a longer overall gauge pad length is desired for drill bit stability, while a shorter overall gauge pad length is desired for increased side cutting or steering capability. As previously contemplated, for wellbores wherein deviated, curved and non-deviated portions are required or desired, a static gauge pad may be optimized for a certain set of parameters and characteristics. In certain embodiments, static gauge pads 234 may be utilized with the movable members 260*a* discussed herein.

In an exemplary embodiment, the drill bit 200 may further include one or more movable members 260*a* that extend and retract (or translate) axially. In one aspect, the movable members 260*a* (also referred to herein as "movable pads") may be associated with the lateral extents of the bit body 201. In an exemplary embodiment, the moveable members 260*a* are disposed adjacent to the static gauge pads 234 to augment or enhance the characteristics of the static gauge pads 234. In certain embodiments, the moveable members 260*a* are utilized without static gauge pads 234.

In exemplary embodiments, by placing the moveable members 260*a* near the lateral extents of the bit body 201 the effective length and width of the gauge pads (including gauge pads 234) can be changed, increasing the stability or increasing the side cutting of the bit 200.

In an exemplary embodiment, movable member 260 translates in a cavity or recess 250. In certain embodiments, the recess 250 is disposed adjacent to the static gauge pads 234. The movable member 260*a* may extend and retract along the axis 203. In an exemplary embodiment the axis 203 of the moveable member is parallel to longitudinal axis 202 of the drill bit. In other embodiments, the axis 203 is generally substantially longitudinal. Accordingly, movable member 260*a* may generally have a longitudinal component of travel but may also move in a radial direction relative to the bit body 201.

Figure 2B:
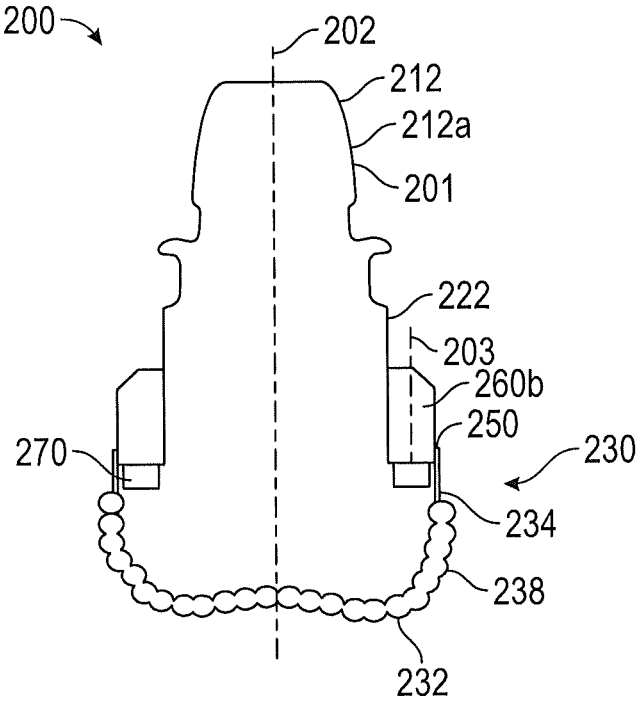
FIG. 2B shows a cross sectional view of the drill bit of FIG. 2A with the adjustable member shown in an extended position.

In certain embodiments, the movable member 260*a* may be selectively extended from a retracted location to an extended location. FIG. 2A shows the moveable member 260*a* in a fully retracted position, while FIG. 2B shows moveable member 260*b* in a fully extended position. In an exemplary embodiment, the members 260*a* can be extended up to 6 inches. In other embodiments, the members may extend any other suitable distance. In certain embodiments, a default location may be selected for the moveable members 260*a,b*. The default location may be fully retracted, fully extended or some position therebetween. Accordingly, the moveable members 260*a,b* may move relative to the default location.

Advantageously, moveable member 260*a,b* may be positioned to facilitate or limit deflection (tilt) of the drill bit 200 and the resulting wellbore. Such tilt or inclination may be measured within drill bit 200 or from external sensors to provide feedback regarding the position of moveable members 260*a,b*. Moveable members 260*a,b* may be used in conjunction with deflection tools to facilitate contours and deflections of the wellbore. Similarly, extending, retracting and generally positioning movable members 260*a,b* can be used to increase or decrease the amount of side cutting the drill bit 200 performs.

As may be appreciated, movable member 260*a,b* may be extended to any location between the retracted location and the fully extended location by a device in the drill bit 200 such as actuator 270. In an exemplary embodiment, actuator 270 is any suitable actuator, including, but not limited to hydraulic, electric, mechanical, and remote actuators. Further, in certain embodiments, the actuator 270 and the associated movable member 260*a,b* is controlled autonomously via feedback systems, sensors, and integrated controlled. In other embodiments, the actuator 270 is controlled by controlled located at a surface location or from other downhole tools. In certain embodiments, actuator 270 may have communication lines to facilitate control and feedback regarding the moveable members 260*a* to ensure desired operation and borehole quality.

Typically static gauge pads 234 experience loading forces within the wellbore as drill bit 200 is drilling through the formation. Similarly, moveable members 260*a,b* may experience loading forces during operation. Advantageously, loading of moveable members 260*a, b* is experienced in a generally radial direction. Accordingly, in certain embodiments, the movement of moveable members 260*a,b* is generally not resisted or subject to loading forces experienced during operation. Therefore a non-linear amount of force is required to position and maintain the position of the moveable members 260*a,b* relative to the displacement and position of the moveable members 260*a,b*. Accordingly, actuators 270 are not required to supply as much force to maintain a gauge pad length compared to conventional designs.

Figure 2C:
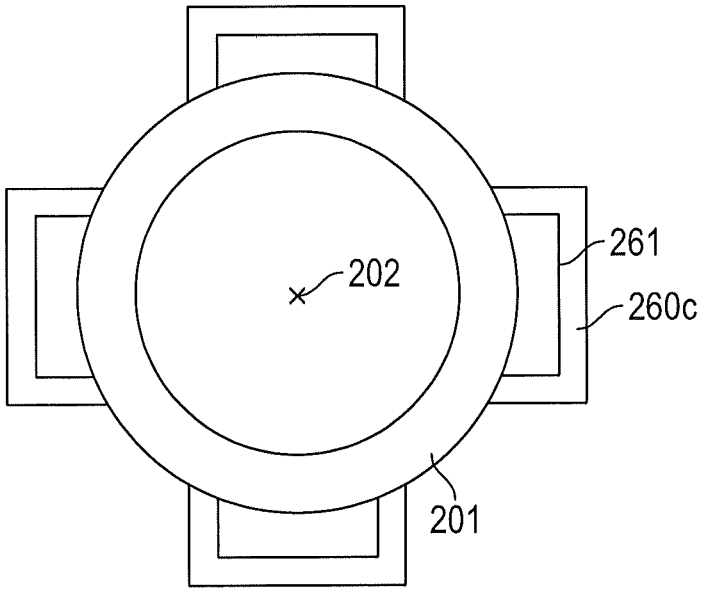
FIG. 2C shows a partial cross sectional view of an embodiment of the drill bit shown in FIG. 2A.
Figure 2D:
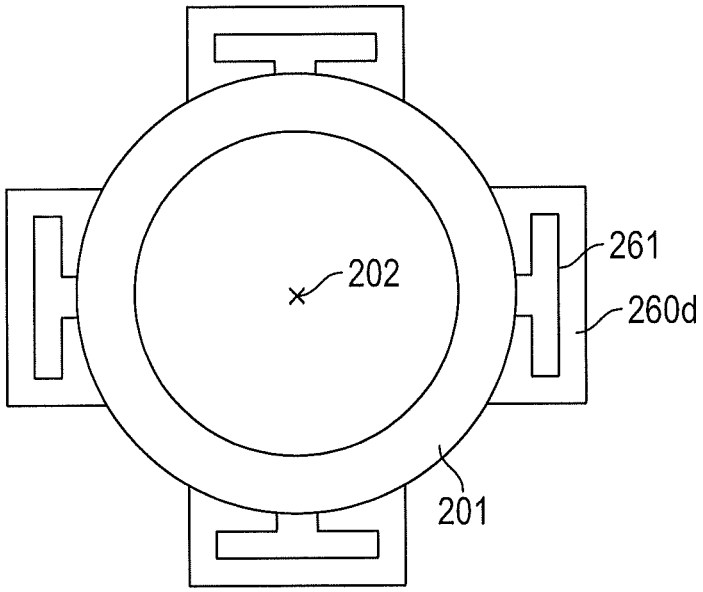
FIG. 2D shows another partial cross section view of another embodiment of the drill bit shown in FIG. 2A.

FIG. 2C and FIG. 2D show partial cross sections of drill bit 200. In FIG. 2C moveable member 260*c* utilizes bit body 201 as a bearing surface. Further, in certain embodiments, moveable member 260*c* maintains a sliding relationship with retainer 261 to support and capture moveable member 260*c*. Similarly, recess 250 (not shown) may be used in conjunction with these bearing surfaces to provide support and a sliding surface for moveable member 260*c*. Similarly, FIG. 2D shows alternative retainer 261 to retain and support moveable member 260*d*. Advantageously, the use of retainers 261 allows for retention of moveable members 260*c,d* while providing for loading forces experienced during operation.

Figure 3A:
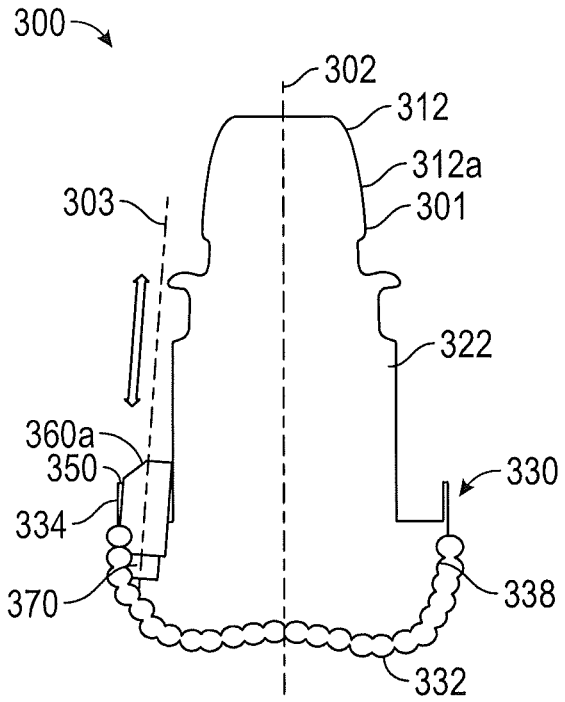
FIG. 3A shows a cross sectional view of an exemplary drill bit with an adjustable member on a bit body, in a retracted position, according to another embodiment of the disclosure.
Figure 3B:
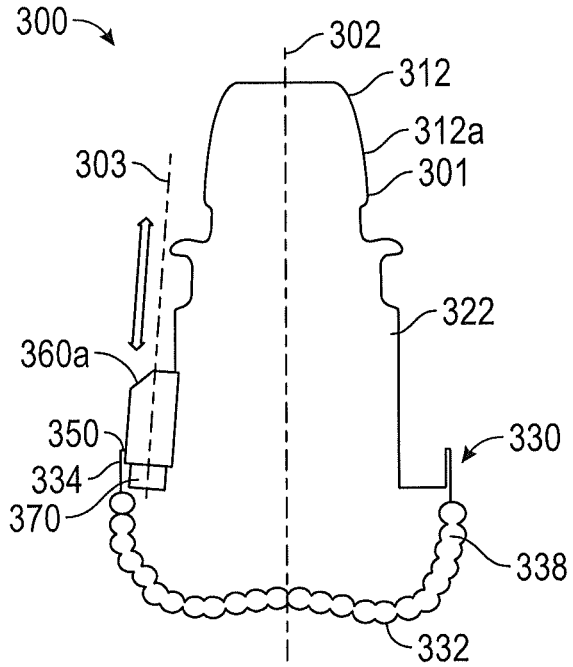
FIG. 3B shows a cross sectional view of the drill bit of FIG. 3A with the adjustable member shown in an extended position.

FIGS. 3A and 3B show an alternative embodiment of drill bit 300. In certain embodiments, moveable member 360*a,b* moves along an axis 303 tilted toward the central longitudinal axis 302 of the drill bit 300. Accordingly, as the moveable member 360*a,b* is moved to an extended position, the moveable member 360*a,b* moves longitudinally, and radially inward toward the axis 302. Similarly, as moveable members 360*a,b* are retracted, the members 360*a,b* move away from axis 302.

Figure 4A:
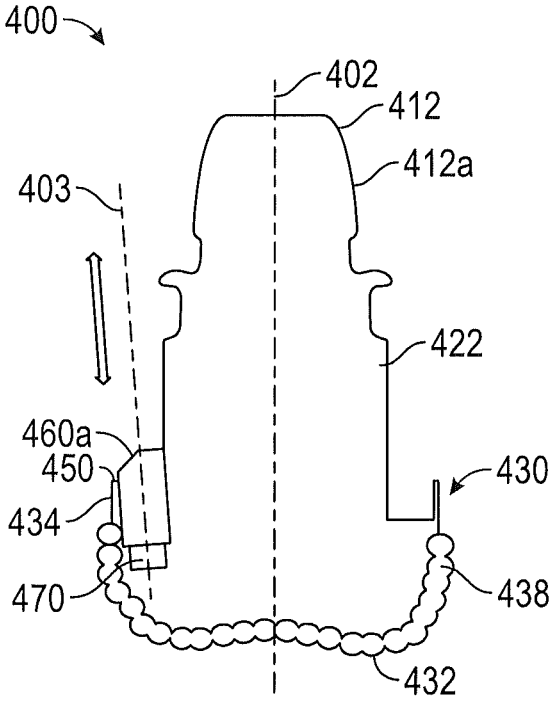
FIG. 4A shows a cross sectional view of an exemplary drill bit with an adjustable member on a bit body, in a retracted position, according to another embodiment of the disclosure.
Figure 4B:
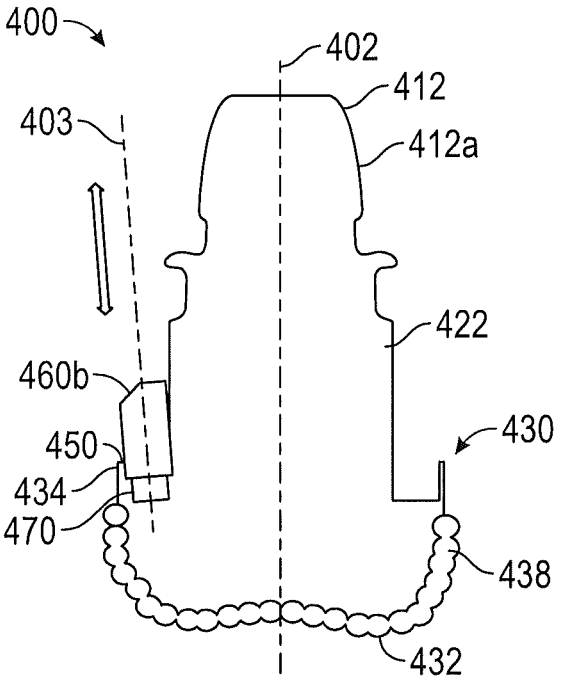
FIG. 4B shows a cross sectional view of the drill bit of FIG. 4A with the adjustable member shown in an extended position.

FIGS. 4A and 4B show an alternative embodiment of drill bit 400. In certain embodiments, moveable member 460*a,b* moves along an axis 403 tilted away from the central longitudinal axis 402 of the drill bit 400. Accordingly, as the moveable member 460*a,b* is moved to an extended position, the moveable member 460*a,b* moves longitudinally, and radially outward away from the axis 402. Similarly, as moveable members 460*a,b* are retracted, the members 460*a,b* move radially inward toward the axis 402.

Therefore in one aspect, a drill bit for use in a wellbore is disclosed, including a bit body having a longitudinal axis; and at least one moveable member associated with a lateral extent of the bit body, wherein the at least one moveable member is configured to translate in a member axis that is substantially longitudinal. In certain embodiments, the member axis is parallel to the longitudinal axis. In certain embodiments, the member axis is disposed to configure the at least one movable member to extend toward the longitudinal axis. In certain embodiments, the member axis is disposed to configure the at least one movable member to extend away from the longitudinal axis. In certain embodiments, the drill bit includes at least one static member associated with a lateral extent of the bit body. In certain embodiments, the at least one moveable member has a sliding relationship with the bit body. In certain embodiments the drill bit includes at least one bearing surface of the bit body associated with the at least one moveable member. In certain embodiments, the at least one moveable member is retained by the bit body.

In another aspect, a method of drilling a wellbore is disclosed, including providing a drill bit including a bit body having a longitudinal axis and at least one movable member associated with a lateral extent of the bit body; conveying a drill string into a formation, the drill string having the drill bit at the end thereof; drilling the wellbore using the drill string; and selectively translating at least one movable member in a member axis that is substantially longitudinal. In certain embodiments, the method further includes drilling a vertical section of the wellbore using the drill string; selectively extending the at least one movable member. In certain embodiments, the method further includes drilling a deviated section of the wellbore using the drill string; selectively retracting the at least one movable member. In certain embodiments, the method further includes disposing the member axis to configure the at least one movable member to extend toward the longitudinal axis. In certain embodiments, the method further includes disposing the member axis to configure the at least one movable member to extend away from the longitudinal axis. In certain embodiments, the method further includes sliding the at least one movable member against the bit body.

In another aspect, a system for drilling a wellbore is disclosed, including a drilling assembly having a drill bit configured to drill a wellbore, the drill bit including: a bit body having a longitudinal axis; at least one moveable member associated with a lateral extent of the bit body, wherein the at least one moveable member is configured to translate in a member axis that is substantially longitudinal. In certain embodiments, the at least one movable member is configured to be controlled autonomously. In certain embodiments, the at least one movable member is configured to be controlled via a controller. In certain embodiments, the controller is a controller of a downhole tool. In certain embodiments, the member axis is disposed to configure the at least one movable member to extend toward the longitudinal axis. In certain embodiments, the member axis is disposed to configure the at least one movable member to extend away from the longitudinal axis.

The invention claimed is:

1. A drill bit for use in a wellbore, comprising:

a bit body having a longitudinal axis, a crown including a plurality of cutters, wherein the crown is stationary relative to the bit body, and a gauge section associated with the lateral extent of the bit body, the gauge section including:

a static member, a cavity formed in the bit body adjacent to the static member, and a moveable member received by the cavity and configured to translate relative to the bit body along a substantially longitudinal member axis, wherein the movable member extends from the cavity to increase a length of the gauge section and retracts into the cavity to decrease the length of the gauge section.

2. The drill bit of claim 1, wherein the substantially longitudinal member axis is parallel to the longitudinal axis.

3. The drill bit of claim 1, wherein the substantially longitudinal member axis is disposed to configure the movable member to extend from the cavity toward the longitudinal axis.

4. The drill bit of claim 1, wherein the substantially longitudinal member axis is disposed to configure the movable member to extend from the cavity away from the longitudinal axis.

5. The drill bit of claim 1, wherein the moveable member has a sliding relationship with the bit body.

6. The drill bit of claim 1, further comprising at least one bearing surface of the bit body associated with the moveable member.

7. The drill bit of claim 1, wherein the moveable member is retained by the bit body.

8. The drill bit of claim 1, wherein the moveable member is a moveable gauge pad.

9. A method of drilling a wellbore, comprising:

providing a drill bit including a bit body having a longitudinal axis, a crown including a plurality of cutters, wherein the crown is stationary relative to the bit body, and a gauge section associated with the lateral extent of the bit body, the gauge section including:

a static member, a cavity formed in the bit body adjacent to the static member, and a moveable member received by the cavity and and configured to translate relative to the bit body along a substantially longitudinal member axis, wherein the movable member extends from the cavity to increase a length of the gauge section and retracts into the cavity to decrease the length of the gauge section;

conveying a drill string into a formation, the drill string having the drill bit at the end thereof;

drilling the wellbore using the drill string; and selectively translating the at least one movable member relative to the bit body along a substantially longitudinal member axis in order to change the length of the gauge section.

10. The method of claim 9, further comprising:

drilling a vertical section of the wellbore using the drill string;

selectively extending the movable member.

11. The method of claim 9, further comprising:

drilling a deviated section of the wellbore using the drill string;

selectively retracting the movable member.

12. The method of claim 9, further comprising disposing the substantially longitudinal member axis to configure the movable member to extend from the cavity toward the longitudinal axis.

13. The method of claim 9, further comprising disposing the substantially longitudinal member axis to configure the movable member to extend from the cavity away from the longitudinal axis.

14. The method of claim 9, further comprising sliding the movable member against the bit body.

15. A system for drilling a wellbore, comprising:

a drilling assembly having a drill bit configured to drill a wellbore, the drill bit including:

a bit body having a longitudinal axis, a crown including a plurality of cutters, wherein the crown is stationary relative to the bit body, and a gauge section associated with the lateral extent of the bit body, the gauge section including:

a static member, a cavity formed in the bit body adjacent to the static member, and a moveable member received by the cavity and is configured to translate relative to the bit body along a substantially longitudinal member axis, wherein the movable member extends from the cavity to increase a length of the gauge section and retracts into the cavity to decrease the length of the gauge section.

16. The system of claim 15, wherein the movable member is configured to be controlled autonomously.

17. The system of claim 15, wherein the movable member is configured to be controlled via a controller.

18. The system of claim 17, wherein the controller is a controller of a downhole tool.

19. The system of claim 15, wherein the substantially longitudinal member axis is disposed to configure the movable member to extend from the cavity toward the longitudinal axis.

20. The system of claim 15, wherein the substantially longitudinal member axis is disposed to configure the movable member to extend from the cavity away from the longitudinal axis.

* * * * *